US008393555B2

(12) United States Patent
Niemela et al.

(10) Patent No.: US 8,393,555 B2
(45) Date of Patent: Mar. 12, 2013

(54) MOISTENING NOZZLE OF A PAPER WEB

(75) Inventors: Hannu Niemela, Kangasala (FI); Niko Posti, Tampere (FI); Jari Almi, Pirkkala (FI)

(73) Assignee: Metso Automation Oy, Helsinki (FI)

( * ) Notice: Subject to any disclaimer, the term of this patent is extended or adjusted under 35 U.S.C. 154(b) by 631 days.

(21) Appl. No.: 11/988,373

(22) PCT Filed: Jul. 6, 2006

(86) PCT No.: PCT/FI2006/050320

§ 371 (c)(1),
(2), (4) Date: Apr. 11, 2008

(87) PCT Pub. No.: WO2007/006861

PCT Pub. Date: Jan. 18, 2007

(65) Prior Publication Data

US 2009/0057439 A1 Mar. 5, 2009

(30) Foreign Application Priority Data

Jul. 7, 2005 (FI) ..... 20055394

(51) Int. Cl.
*B05B 7/12* (2006.01)
*B05B 7/10* (2006.01)
*B05B 7/04* (2006.01)

(52) U.S. Cl. ..... 239/416.5; 239/399; 239/403; 239/416.4; 239/433; 239/418

(58) Field of Classification Search ..... 239/398, 239/399, 403, 406, 416.4, 416.5, 417.5, 418, 239/433, 434.5
See application file for complete search history.

(56) References Cited

U.S. PATENT DOCUMENTS 1,474,603 A * 11/1923 Morse ..... 239/404
1,609,841 A * 12/1926 Smith ..... 239/432
3,375,978 A * 4/1968 Rennie ..... 239/113
(Continued)

FOREIGN PATENT DOCUMENTS

DE 952 765 4/1957
DE 40 38 191 A1 8/1992
(Continued)

OTHER PUBLICATIONS

Jul. 28, 2011 Extended European Search Report issued in European Application No. 06764554.9.

*Primary Examiner* — Len Tran
*Assistant Examiner* — Justin Jonaitis
(74) *Attorney, Agent, or Firm* — Oliff & Berridge, PLC

(57) ABSTRACT

A moistening nozzle of a paper web comprises a frame into which air and water are fed. Inside the frame there is arranged a water nozzle wherewith water is conducted to an outlet of the moistening nozzle and an air nozzle wherewith air is correspondingly conducted to the outlet. The air nozzle and the water nozzle are arranged one within the other such that the air and the water form water mist that is sprayed out from the moistening nozzle. The air nozzle is provided with a thread that brings the air in swirling motion. The air nozzle comprises a sleeve part with an opening through which air is discharged and in said opening there is arranged a piece that is an integral part of the frame of the moistening nozzle, whereby a part of the moistening nozzle frame forms an inner edge of the air gap provided by said piece and the sleeve part.

22 Claims, 3 Drawing Sheets

U.S. PATENT DOCUMENTS 3,587,974 A * 6/1971 Rosenkranz et al. ..... 39/423
4,453,542 A 6/1984 Hughes
4,946,101 A 8/1990 Winheim
5,292,068 A 3/1994 Raterman et al.
5,692,682 A * 12/1997 Soule ..... 239/403
5,697,553 A 12/1997 Stotts
6,036,116 A * 3/2000 Bui ..... 239/432
6,045,058 A 4/2000 Dobbeling et al.
6,148,536 A * 11/2000 Iijima ..... 34/92

FOREIGN PATENT DOCUMENTS

DE 199 49 236 A1 6/2001
FI 91366 B 12/1989

* cited by examiner

MOISTENING NOZZLE OF A PAPER WEB

BACKGROUND OF THE INVENTION

The invention relates to a moistening nozzle of a paper web comprising a frame to which air and water are fed, a water nozzle arranged inside the frame to conduct water out of the moistening nozzle and an air nozzle to conduct air out of the moistening nozzle, and in connection with the air nozzle there are means that bring the air into swirling motion and the air nozzle and the water nozzle are arranged one within the other to allow the air and the water to produce water mist that is sprayed out from the moistening nozzle and the air nozzle comprises a sleeve part having an opening through which the air is conducted out of the moistening nozzle and in a centralized manner with said opening there is arranged a piece, whereby said piece and the sleeve part provide an air gap.

The paper web is moistened to control the moisture profile of the paper web, for instance. Moistening can also be employed to control the curling of the paper web on the paper machine. Further, in online calendering, for instance, the management of given quality parameters requires moistening of good quality with water.

The paper web is moistened with a moistening apparatus that comprises a plurality of moistening nozzles in the cross direction of the paper web, which nozzles are used for blowing water mist containing air and water onto the surface of the paper web. DE 952 765 discloses a moistening nozzle. Said moistening nozzle comprises an air nozzle and a water nozzle arranged nested therein. The air nozzle comprises an external thread that brings the air into swirling motion. The swirling air that flows out captures the water from the periphery to form small particles. Said moistening nozzle provides a hollow cone spray pattern. The air and water nozzles are arranged inside the frame of the moistening nozzle with a mutual threaded joint in as centralized a manner as possible so that a gap between them is as even as possible. Due to the securing manner it is difficult to achieve or maintain centricity and evenness of the gap and consequently the spray pattern differs easily from the desired shape. All in all, the structure of the moistening nozzle is relatively difficult in the respect that it is very difficult to make moistening nozzles providing homogeneous sprays.

FI publication 91 366 discloses a moistening nozzle for a paper web, which also comprises a water nozzle in the middle of the moistening nozzle frame and an air nozzle arranged outside the water nozzle. In connection with the air nozzle there is a spiral piece with an external thread to bring the air flow into swirling motion. The water nozzle and the air nozzle are mutually arranged to secure one another. In addition, between the air nozzle and the water nozzle there is provided a ring-shaped gap whose width in the circumferential direction remains unchanged. The structure of this moistening nozzle is relatively complicated and therefore the moistening nozzle is difficult to manufacture. All in all, it is relatively difficult to center the air nozzle and the water nozzle in the moistening nozzle, and consequently it is very difficult to manufacture moistening nozzles that provide mutually homogeneous sprays.

BRIEF DESCRIPTION OF THE INVENTION

The object of the invention is to provide a moistening nozzle of a novel type for a paper web.

The moistening nozzle of the paper web in accordance with the invention is characterized in that the piece arranged in a centralized manner with said opening is an integral part of the moistening nozzle frame, whereby a part of the moistening nozzle frame constitutes an inner edge of said air gap.

The basic idea of the invention is that the moistening nozzle comprises a frame to which air and water are fed. Inside the frame there is arranged a water nozzle wherewith the water is conducted to an outlet of the moistening nozzle, and an air nozzle wherewith the air is correspondingly conducted to the outlet. The air nozzle and the water nozzle are nested one within the other so that the air and the water form water mist that is blown out from the moistening nozzle. The air nozzle comprises means that bring the air into swirling motion. Further, it is substantial that the air nozzle comprises a sleeve part having an opening through which the air is discharged and in said opening there is arranged a piece that is an integral part of the moistening nozzle frame, whereby the inner edge of the air gap formed by the said piece and the sleeve part is provided by the moistening nozzle frame. Thus it is possible to form a desired air gap very accurately, which ensures very good and even spray. In addition, the dimensional accuracy of the air gap will be retained very well as the moistening nozzle ages.

The basic idea of an embodiment is that the tip part of the water nozzle is provided to be an integral part of the moistening nozzle frame and simultaneously to form an inner edge of the air gap. This permits the tip part of the water nozzle to be fitted in a correct position very accurately and a spray of uniform quality will be provided.

The basic idea of a second embodiment of the invention is that the air nozzle comprises a threaded piece provided with an internal thread. That enables a very good and even spray. Providing threads on the inner surface of the air nozzle further enables an embodiment in which the outer surface of the threaded piece is supported to the frame of the moistening nozzle. Thus the threaded piece can be supported accurately with slight tolerance to a desired point and the water spray provided by the moistening nozzle is even.

It is set forth in this description that air and water are used for moistening, but the use of other gases and liquids is also possible, so in connection with this description the term 'air' refers to any gas or gas mixture useful in connection with paper web moistening, and correspondingly, the term 'water' refers to any liquid or liquid mixture suitable for paper web moistening.

BRIEF DESCRIPTION OF THE DRAWINGS

In the following the invention will be described in greater detail in the attached drawings, wherein.

For the sake of clarity some embodiments of the invention are depicted simplified in the figures. Like reference numerals refer to like parts in the figures.

DETAILED DESCRIPTION OF THE INVENTION

Figure 1:
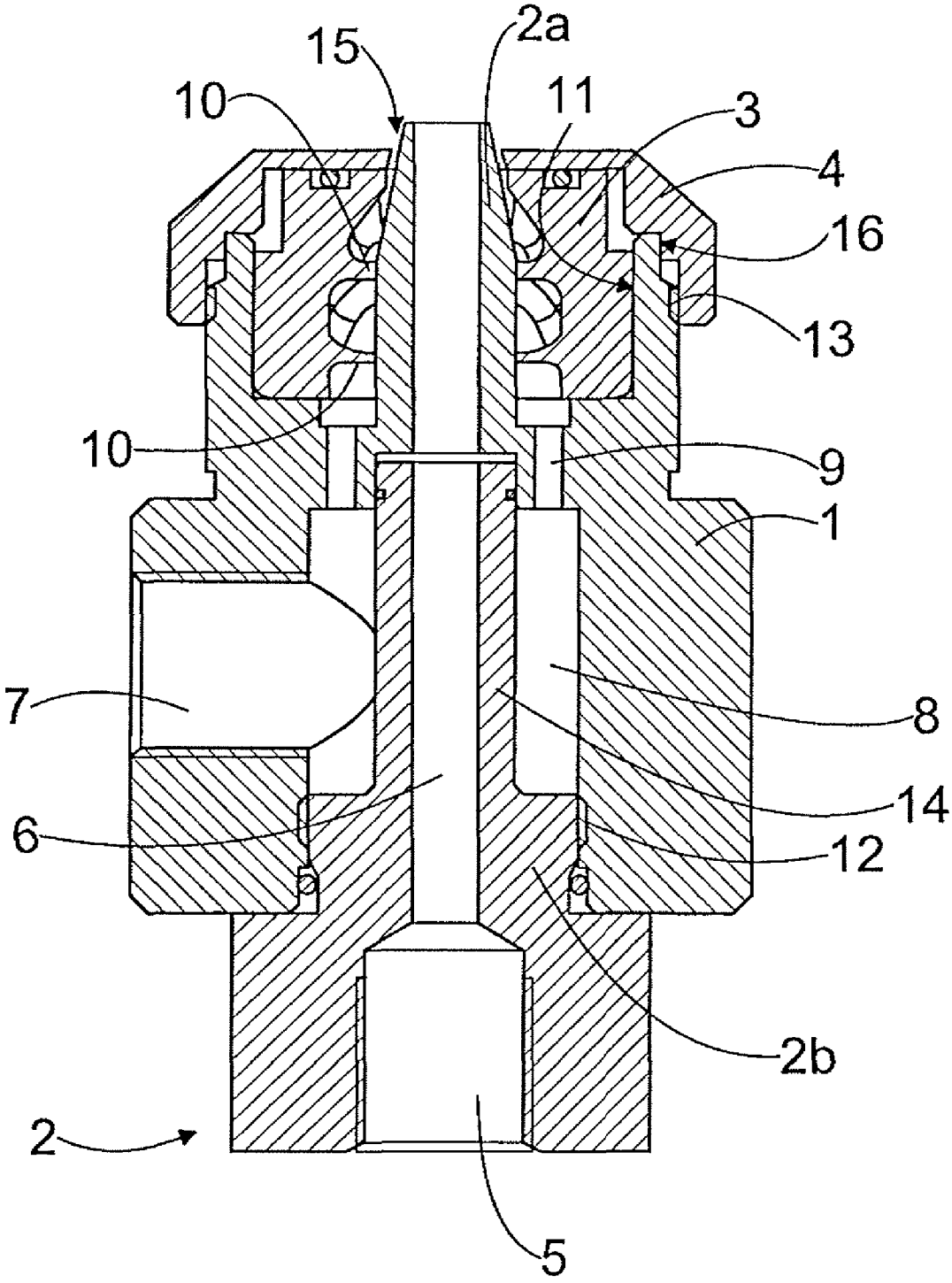
FIG. 1 is a schematic cross-sectional side view of a moistening nozzle of a paper web.

FIG. 1 shows a moistening nozzle having a frame 1. Inside the frame 1 there is arranged a water nozzle 2. A rear part 2*b* of the water nozzle 2 is connected to the inside of the frame 1 with a threaded joint 12. Further, inside the frame 1 there is arranged a threaded piece 3 of an air nozzle such that the water nozzle 2 and the threaded piece 3 are concentric. The threaded piece 3 is secured to the frame 1 with an air nozzle sleeve part 4 that is connected to the exterior of the frame 1 with a threaded joint 13.

The water nozzle 2 includes a water connector 5, into which water is fed with a pipe or a hose or the like. The water connector 5 comprises, for instance, a thread for connecting the pipe or the hose. From the water connector 5 the water flows through a water duct 6 out of the water nozzle. In the frame 1 there is arranged an air connector 7, to which a pipe or a hose or the like is connected with a threaded joint, for instance, for feeding air to the moistening nozzle. The water is fed into the moistening nozzle, i.e. in the middle of the moistening nozzle, from the rear part thereof, and the air is fed to the moistening nozzle from the side of the moistening nozzle.

From the air connector 7 the air is conducted to an air chamber 8 that is arranged around a shaft 14 of the water nozzle. From the air chamber 8 the air flows through apertures 9 in the frame 1 towards the threaded piece 3.

The threaded piece 3 comprises an internal thread 10 which is provided on the inner surface of the threaded piece 3 and by which the air is brought to swirling motion. The air in swirling motion thus flows through an air gap 15 in the moistening nozzle to surround the water from the water nozzle 2, whereby the mixture of water and air form water mist. Thanks to the swirling motion the water mist forms an even cone-shaped spray.

The threaded piece 3 is arranged inside the frame 1 such that the threaded piece is positioned into place against a control surface 11 of the air nozzle inside the frame 1. The control surface 11 of the air nozzle is located around the central axis of the moistening nozzle in the circumferential direction.

Between the different pieces of the moistening nozzle it is possible to arrange seals in necessary places. The seals may be O-ring seals of EPDM rubber, for instance.

The threaded piece 3 is advantageously provided by moulding it in one piece. If desired, the threaded piece 3 may also consist of several pieces. The threaded piece 3 can be made of plastic or another material suitable for moulding, for instance, by injection moulding. The plastic material should be such that it does not absorb water and resists heat at least 180° C., for instance. One plastic grade suitable for the purpose is polyethersulphone PES.

When the threaded piece 3 is manufactured by moulding, it is relatively easy to make air nozzles with various threads 10, for instance. Thus, by changing the threaded piece in the moistening nozzle it is possible to provide various spray patterns. For instance, the angle of the threads 10 may vary within the range of 0 to 90 degrees. Further, the depth of thread may vary in the desired manner. Other parts of the moistening nozzle may be made of steel, for instance.

In FIG. 1 the water nozzle 2 consists of two pieces. The tip part 2*a* of the water nozzle, i.e. the nozzle pipe, is provided to form an integral part of the nozzle frame 1. Thus the tip part 2*a* of the water nozzle and a control surface 11 of the air nozzle can be machined in the same machining step and with one attachment of the machining tool. In this manner it is possible to set the threaded piece 3 and the tip part 2*a* of the water nozzle very accurately into place with respect to one another, which ensures a very good and even spray. Thanks to the structure it is also very easy to assemble the nozzle correctly and the dimensional accuracy of the air gap 15 will be retained as the moistening nozzle ages.

The rear part 2*b* of the water nozzle, i.e. a hollow conductor, is a separate piece and it is secured to the frame 1 with a threaded joint 12. The tolerances in the interconnection of the rear part 2*b* of the water nozzle and the frame 1 need not be very accurate, but nevertheless the moistening nozzle produces an even spray. It will suffice that the rear part 2*b* of the water nozzle is tightly secured to the frame 1 such that the water runs smoothly through the water duct 6. If desired, the water nozzle 2 in the whole could be made to form an integral part of the nozzle frame 1, but for instance, when the moistening nozzle is made of metal the manufacturing of a piece by machining is considerably easier if the rear part 2*b* of the water nozzle is a separate piece that is secured to the frame 1.

The middle portion of the sleeve part 4 extends to the vicinity of the tip part 2*a* of the water nozzle. The dimensions of the tip part 2*a* of the water nozzle and the sleeve part 4 determine the size and shape of the air gap 15 outside the water nozzle 2. The size and shape of the air gap 15 have a considerable effect on the operation of the nozzle. Advantageously the air gap 15 is ring-shaped and concentric with the water nozzle 2, but it may also have some other shape. On the outer surface of the frame 1 there is a control surface 16 of the sleeve part. The control surface 16 of the sleeve part is around the central axis of the moistening nozzle in the circumferential direction. By means of the control surface 16 the sleeve part 4 is positioned into place. As the tip part 2*a* of the water nozzle, the threaded joint 13 and the control surface 16 of the sleeve part can be machined in the same machining step and with one attachment of the machining tool, the tip part 2*a* of the water nozzle and the sleeve part 4 can be mutually mounted into place with great accuracy. Consequently, the air gap 15 between the tip part 2*a* and the sleeve part 4 can be formed with great accuracy to have a desired shape, which ensures very good and even spray. Thanks to the structure it is also very easy to assemble the nozzle correctly and the dimensional accuracy of the air gap 15 will be retained as the moistening nozzle ages.

Advantageously the threaded piece 3 is manufactured by moulding into one piece. Moulding within the limits of the dimensional accuracy requirements set for the threaded piece 3 is relatively difficult, however. Instead, when the sleeve part 4 is made of metal by machining, the dimensions thereof will be accurate. In addition, when the sleeve part 4 is arranged in the above-described manner accurately concentric with the tip part 2*a* of the water nozzle, the air gap 15 will be provided to have precisely the desired shape, and consequently the function of the threaded piece 3 is just to bring the air into swirling motion.

Figure 2:
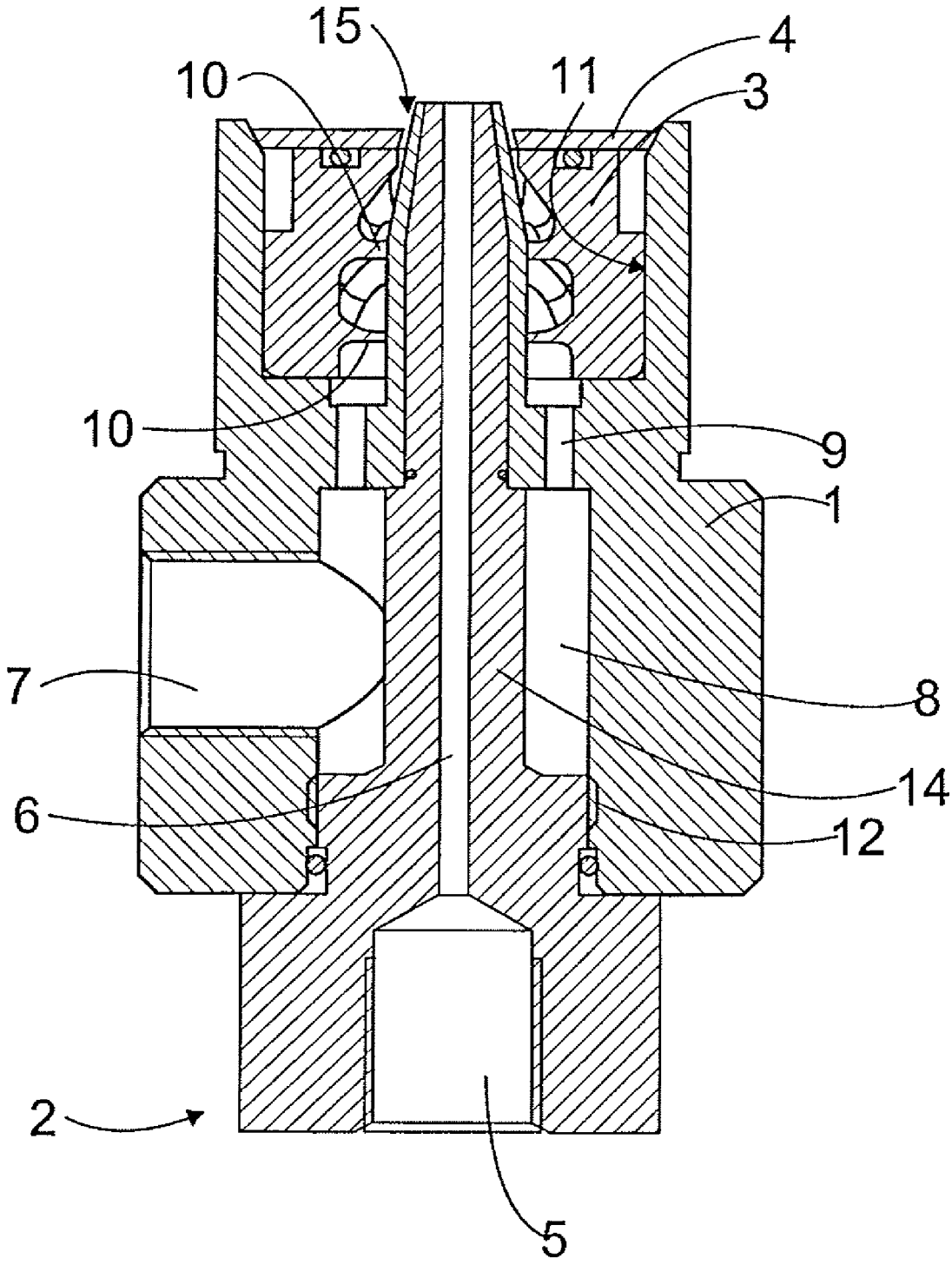
FIG. 2 is a schematic cross-sectional side view of a second moistening nozzle of a paper web.

In the moistening nozzle of FIG. 2 the inner edge of the air gap 15 is formed by a rod-shaped middle portion of the moistening nozzle. This rod-shaped middle portion is hollow and the water nozzle 2 is arranged inside it. In the moistening nozzle of FIG. 2 the rear part and the tip part of the water nozzle are provided to be an integral part.

The moistening nozzle of FIG. 2 also differs from that of FIG. 1 as regards the sleeve part 4. In the moistening nozzle of FIG. 2 the sleeve part 4 is a plate with an aperture in the middle. In FIG. 2 the sleeve part 4 is positioned accurately into place by means of conical surfaces. The sleeve part 4 may thus be secured to the frame 1, for instance, by a welded or glued joint, or by means of a separate tightening screw.

Figure 3:
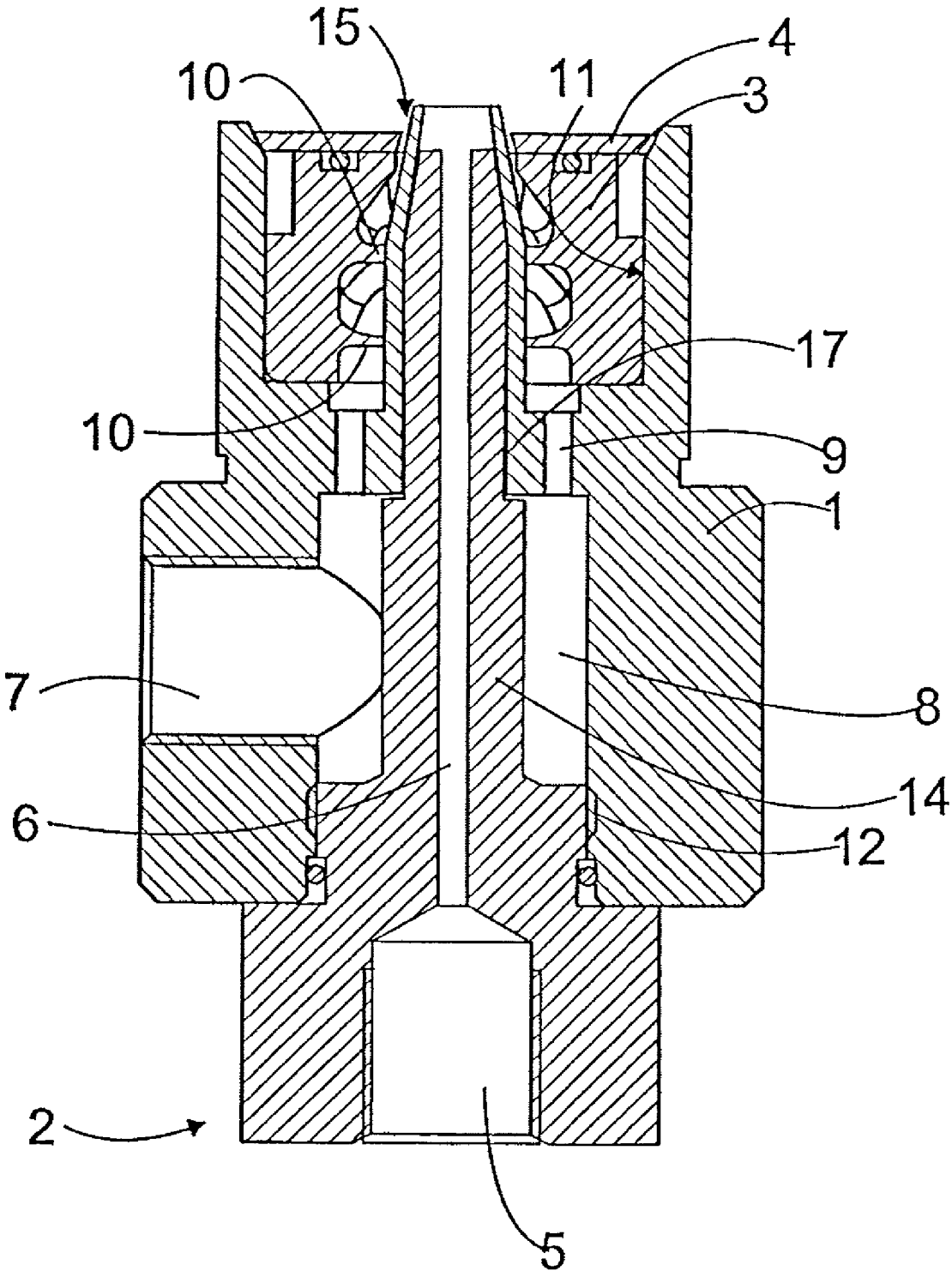
FIG. 3 is a schematic cross-sectional side view of a third moistening nozzle of a paper web.

In the embodiment of FIG. 3 the tip of the water nozzle 2 ends on the level of the lower surface of the sleeve part 4. In some embodiment the tip may also end below the sleeve part 4. The part of the frame 1 forming the inner edge of the air gap 15 may extend above the sleeve part 4 as is shown in the attached figures. In some embodiments said part may also end on the level of the upper part of the sleeve part 4 or even on the level of the lower part thereof.

Further, in the embodiment of FIG. 3 there is arranged an auxiliary duct 17 between the tip of the water nozzle 2 and the frame 1. The auxiliary duct 17 provides another passage for air, whereby the moistening nozzle forms two air sprays one within the other. The auxiliary duct 17 may be straight or it may be provided with means for bringing the air into swirling motion. The air may be brought to swirl in the same or in the opposite direction with the air in the outer air spray. Thus the thread, spoilers or grooves in the auxiliary duct 17 may be arranged at an angle of 0 to 180 degrees in relation to the longitudinal axis of the auxiliary duct.

Also, in the embodiment of FIG. 3, because the tip of the water nozzle 2 ends before the tip of the middle part of the frame 1, in the moistening nozzle there is first formed a supplementary air spray and thereafter another air spray from the air gap 15.

Air pressure of the air constituting the auxiliary air spray may be arranged different from that of the air spray discharging from the air gap 15 by choking the airflows. Thus the relation between the cross sectional surfaces of the apertures 9 and the auxiliary duct 17 determines said difference in pressure. Thus, in a given moistening nozzle structure the pressure difference remains substantially constant. It is also possible to arrange two separate air intakes in the moistening nozzle, whereby air is fed in the apertures 9 from a first air source and air is fed in the auxiliary duct 17 from a second air source. Hence, the air pressures in moistening nozzle parts producing different air sprays can be adjusted as desired.

In some cases the features set forth in this document can be used as such, irrespective of other features. On the other hand, when necessary, the features set forth in this document can be combined to provide various combinations.

The drawings and the relating description are only intended to illustrate the inventive idea. The details of the invention may vary within the scope of the claims. Thus, for instance, the threads 10 provided in the threaded part 3 can be formed to make the air spray swirl clockwise or anticlockwise. On the other hand, it is also possible to manufacture some of the moistening nozzles such that the spray swirls clockwise and others such that the air spray swirls anticlockwise. In that case some of the moistening nozzles can be mounted on the moistening apparatus such that the spray swirls clockwise and others such that the air spray swirls anticlockwise, and consequently a homogeneous moistening response can be achieved in the moistening apparatus by altering the construction of the nozzle.

The threaded piece may also be provided such that it comprises an external thread. The threaded piece may also be provided such that it has a continuous outer and inner surface and the thread that brings the airflow into swirling motion is provided inside the threaded piece, i.e. such that the threaded piece comprises a helical duct.

Instead of the thread 10, the means in connection with the air nozzle, by which the air is brought into swirling motion, may consist of successive spoilers.

Further, it is possible to combine the water nozzle and the air nozzle by providing the threads or spoilers, which bring the airflow into swirling motion, directly on the exterior of the water nozzle or by drilling air ducts in the water nozzle. The threads or the spoilers may also be provided directly on the inner or outer surface, or both, of the middle part of the frame. If desired, the threaded piece may be provided to be an integral part of the frame. Yet instead of threaded joints it is possible to use, for instance, welded or glued joints or other joints suitable for the purpose in the moistening nozzle.

The invention claimed is:

1. A moistening nozzle of a paper web comprising a frame to which air and water are fed, a water nozzle arranged inside the frame to conduct water out of the moistening nozzle and an air nozzle to conduct air out of the moistening nozzle, and in connection with the air nozzle there are means by which the air is brought into swirling motion and the air nozzle and the water nozzle are arranged one within the other to allow the air and the water to produce water mist that is sprayed out from the moistening nozzle, and in the air nozzle there is a sleeve part having an opening through which the air is conducted out from the moistening nozzle, and in a centralized manner with said opening there is arranged a part of the moistening nozzle frame forming a tip of the water nozzle whereby the part of the moistening nozzle frame forming the tip of the water nozzle and the sleeve part form an air gap, and the part of the moistening nozzle frame forming the tip of the water nozzle forms an inner edge of said air gap.

2. A moistening nozzle as claimed in claim 1, wherein a tip part of the water nozzle is the part of the moistening nozzle frame forming the tip of the water nozzle, the tip part forms the inner edge of the air gap.

3. A moistening nozzle as claimed in claim 2, wherein a rear part of the water nozzle is provided to be a separate piece from the tip part.

4. A moistening nozzle as claimed in claim 1, wherein a rod-like middle part of the moistening nozzle frame forms the inner edge of said air gap, within which middle part there is arranged the tip of the water nozzle.

5. A moistening nozzle of a paper web as claimed in claim 1, wherein the air nozzle comprises a threaded piece provided with an internal thread.

6. A moistening nozzle of a paper web as claimed in claim 5, whereby inside the frame there is a control surface of the air nozzle, to which the outer surface of the threaded piece is supported.

7. A moistening nozzle of a paper web as claimed in claim 6, wherein the control surface of the air nozzle is in the direction of the circumference around the central axis of the moistening nozzle.

8. A moistening nozzle of a paper web as claimed in claim 5, wherein the threaded piece is a moulded piece.

9. A moistening nozzle of a paper web as claimed in claim 8, wherein the threaded piece is made of plastic.

10. A moistening nozzle of a paper web as claimed in claim 5, wherein the threaded piece is arranged into place by means of the sleeve part.

11. A moistening nozzle of a paper web as claimed in claim 10, wherein on the outer surface of the frame there is a control surface of the sleeve part, to which the inner surface of the sleeve part is supported.

12. A moistening nozzle of a paper web as claimed in claim 11, wherein the control surface of the sleeve part is in the direction of the circumference around the central axis of the moistening nozzle.

13. A moistening nozzle of a paper web, comprising a frame to which air and water are fed, a water nozzle which is arranged inside the frame and wherewith water is conducted to an outlet of the moistening nozzle and an air nozzle wherewith air is conducted to an outlet of the moistening nozzle, and in connection with the air nozzle there are threads that bring the air into swirling motion and the air nozzle and the water nozzle are arranged one within the other to allow the air and the water to produce water mist that is sprayed out from the moistening nozzle, and in the air nozzle there is a sleeve part having an opening through which the air is conducted out from the moistening nozzle, and a tip part of the water nozzle is a part of the frame forming a tip of the water nozzle whereby the part of the frame forming the tip of the water nozzle and the sleeve part form an air gap, and the part of the moistening nozzle frame forming the tip of the water nozzle forms an inner edge of said air gap.

14. A moistening nozzle as claimed in claim 13, wherein the rear part of the water nozzle is provided to be a separate part from the tip part.

15. A moistening nozzle of a paper web as claimed in claim 13, wherein the air nozzle has an internal thread.

16. A moistening nozzle of a paper web as claimed in claim 15, whereby inside the frame there is a control surface of the air nozzle, to which the outer surface of the air nozzle is supported.

17. A moistening nozzle of a paper web as claimed in claim 16, wherein the control surface of the air nozzle is in the direction of the circumference around the central axis of the moistening nozzle.

18. A moistening nozzle of a paper web as claimed in claim 13, wherein the air nozzle is a moulded piece.

19. A moistening nozzle of a paper web as claimed in claim 18, wherein the air nozzle is made of plastic.

20. A moistening nozzle of a paper web as claimed in claim 13, wherein the air nozzle is arranged into place by means of the sleeve part and that the middle portion of the sleeve part extends to the vicinity of the tip part of the water nozzle such that the tip part of the water nozzle and the sleeve part determine the size of the air gap outside the water nozzle.

21. A moistening nozzle of a paper web as claimed in claim 20, wherein on the outer surface of the frame there is a control surface of the sleeve part, to which the inner surface of the sleeve part is supported.

22. A moistening nozzle of a paper web as claimed in claim 21, wherein the control surface of the sleeve part is in the direction of the circumference around the central axis of the moistening nozzle.

* * * * *